US011062894B2

(12) United States Patent
Saito et al.

(10) Patent No.: US 11,062,894 B2
(45) Date of Patent: Jul. 13, 2021

(54) MASS SPECTROMETER AND MASS SPECTROMETRY METHOD

(71) Applicants: Kabushiki Kaisha Toshiba, Minato-ku (JP); Kogakuin University, Shinjuku-ku (JP)

(72) Inventors: Reiko Saito, Yokohama (JP); Haruko Akutsu, Yokosuka (JP); Tetsuo Sakamoto, Tokyo (JP); Akio Takano, Zama (JP)

(73) Assignees: Kabushiki Kaisha Toshiba, Minato-ku (JP); Kogakuin University, Shinjuku-ku (JP)

( * ) Notice: Subject to any disclaimer, the term of this patent is extended or adjusted under 35 U.S.C. 154(b) by 0 days.

(21) Appl. No.: 16/515,209

(22) Filed: Jul. 18, 2019

(65) Prior Publication Data

US 2019/0341242 A1 Nov. 7, 2019

Related U.S. Application Data

(63) Continuation of application No. PCT/JP2018/017989, filed on May 9, 2018.

(30) Foreign Application Priority Data

May 10, 2017 (JP) ..... JP2017-094046

(51) Int. Cl.
*H01J 49/16* (2006.01)
*H01J 49/04* (2006.01)

(52) U.S. Cl.
CPC ..... *H01J 49/161* (2013.01); *H01J 49/0409* (2013.01)

(58) Field of Classification Search
None
See application file for complete search history.

(56) References Cited

U.S. PATENT DOCUMENTS

2016/0020064 A1* 1/2016 Laue ..... H01J 37/153 250/441.11
2017/0031033 A1* 2/2017 Makarov ..... H01J 49/0004

FOREIGN PATENT DOCUMENTS

| | | | |
|---|---|---|---|
| JP | 63-55846 | | 3/1988 |
| JP | 63055846 A | * | 3/1988 |
| JP | 11-64291 | | 3/1999 |
| JP | 2000-162164 | | 6/2000 |
| JP | 2015-046305 | | 3/2015 |

(Continued)

OTHER PUBLICATIONS

International Search Report dated Aug. 7, 2018 in PCT/JP2018/017989 filed May 9, 2018 (with English Translation).

(Continued)

*Primary Examiner* — Andrew Smyth
(74) *Attorney, Agent, or Firm* — Oblon, McClelland, Maier & Neustadt, L.L.P.

(57) ABSTRACT

According to one embodiment, a mass spectrometer includes a sample stage provided to hold a sample; an analysis unit disposed to face a sample placement surface of the sample table, and performing mass analysis; an ion beam source provided to irradiate an ion beam toward the sample placement surface; an assist energy source supplying assist energy to a target area between the sample placement surface and the analysis unit; and a laser light source irradiating the target area with laser light.

4 Claims, 3 Drawing Sheets

(56) References Cited

FOREIGN PATENT DOCUMENTS

| | | |
|---|---|---|
| JP | 2016-001578 | 1/2016 |
| JP | 2017-054737 | 3/2017 |

OTHER PUBLICATIONS

Written Opinion dated Aug. 7, 2018 in PCT/JP2018/017989 filed May 9, 2018.

* cited by examiner

MASS SPECTROMETER AND MASS SPECTROMETRY METHOD

CROSS-REFERENCE TO RELATED APPLICATION

This application is a Continuation Application of PCT Application No. PCT/JP2018/017989, Filed May 9, 2018 and based upon and claims the benefit of priority from Japanese Patent Application No. 2017-094046, filed May 10, 2017, the entire contents of which are incorporated herein by reference.

FIELD

Embodiments described herein relate generally to a mass spectrometer and a mass spectrometry method.

BACKGROUND

As a mass spectrometer, a secondary ion mass spectrometer (SIMS) is known, in which a solid sample surface is irradiated with an energetic ion beam and sputtered to thereby analyze secondary ions emitted from the sample. Also known is a sputtered neutral mass spectrometry (SNMS), in which particles generated by sputtering from a surface of a sample are irradiated with laser light so that they are photoionized by light absorption just above the sample surface. It has also been proposed to improve the ionization yield of particles by utilizing a tunnel effect via a strong electric field, by means of, for example, a femtosecond laser as laser light, to post-ionize the sputtered neutral particles. For example, in an element with high ionization energy such as an electrically negative element, electrons to be tunneled are at a low possibility, and the ionization yield is insufficient even with a strong electric field by a femtosecond laser, and the sensitivity of analysis may be low.

DETAILED DESCRIPTION

According to one embodiment, a mass spectrometer comprises a sample stage provided to hold a sample; an analysis unit directed to the surface of the sample, and performing mass analysis; an ion beam source provided to irradiate an ion beam toward the sample surface; an assist energy source supplying assist energy to a target atoms or molecules (target) flying between the sample surface and the tip of the mass spectrometer; and in this case a laser light source is placed parallel to the sample surface to irradiate laser light to the target.

Figure 1:
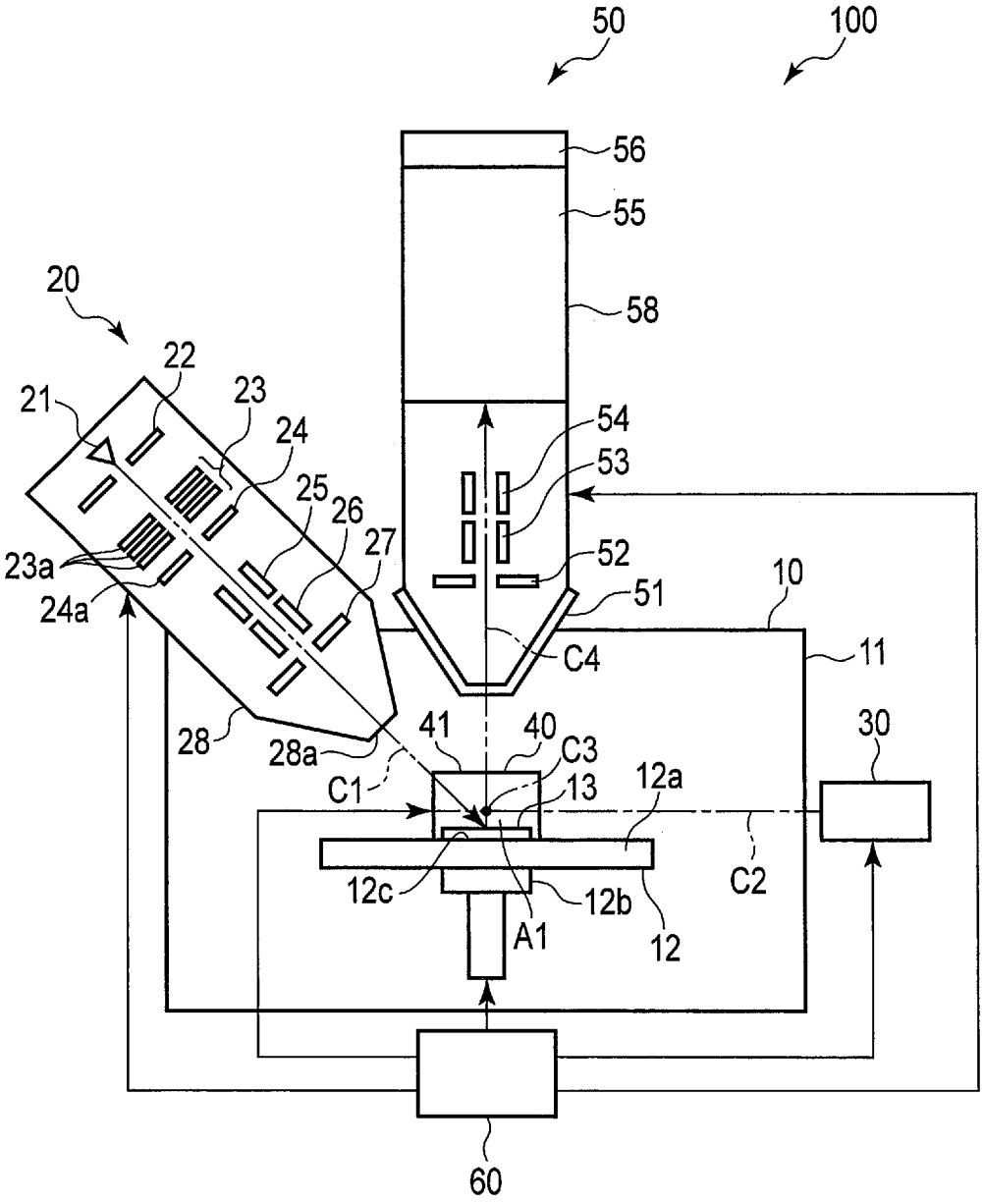
FIG. 1 is an explanatory diagram showing a configuration of a mass spectrometer according to a first embodiment.
Figure 2:
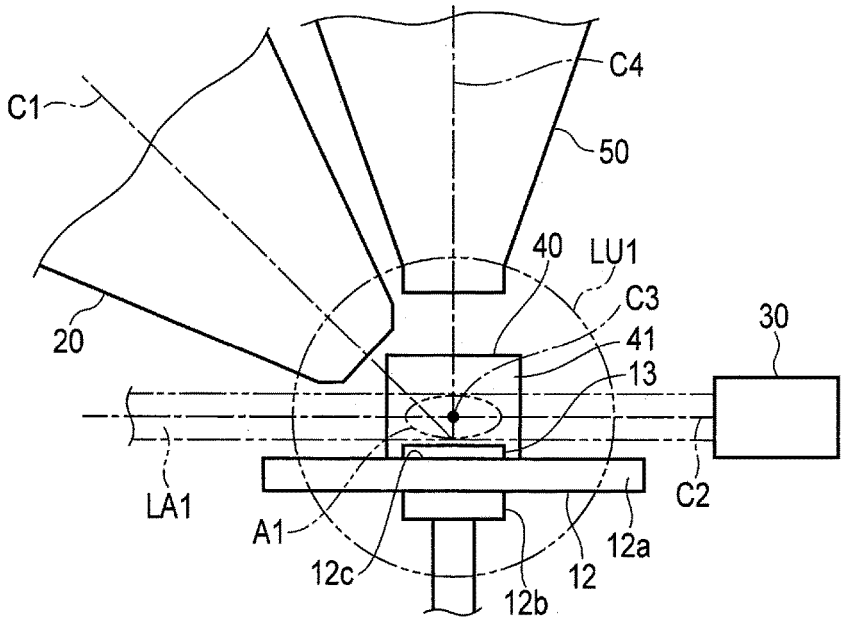
FIG. 2 is an explanatory diagram showing a configuration of a part of the mass spectrometer near a sample.
Figure 3:
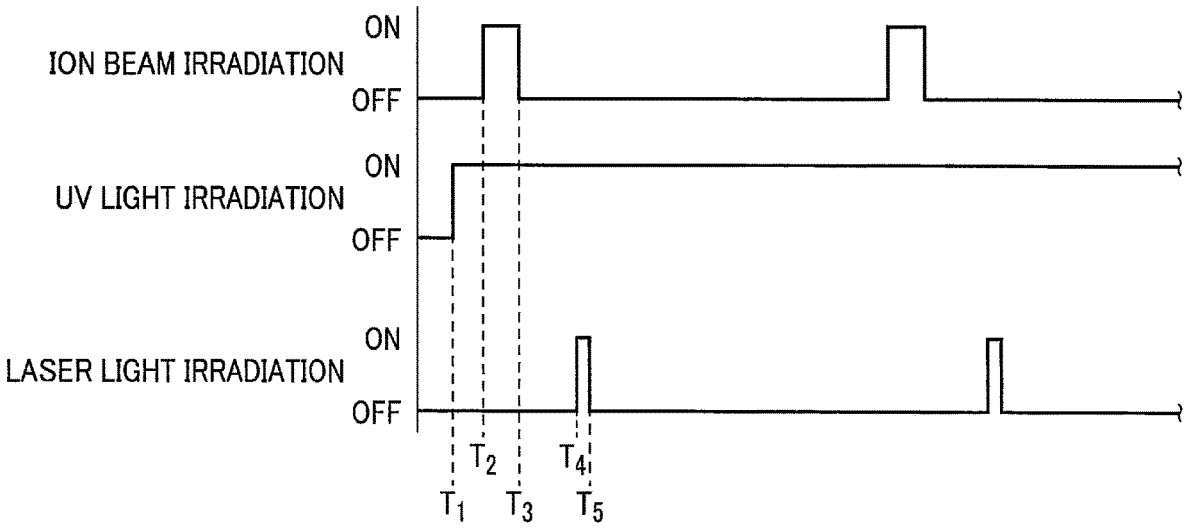
FIG. 3 is an explanatory timing diagram of a mass spectrometry method according to the first embodiment.
Figure 4:
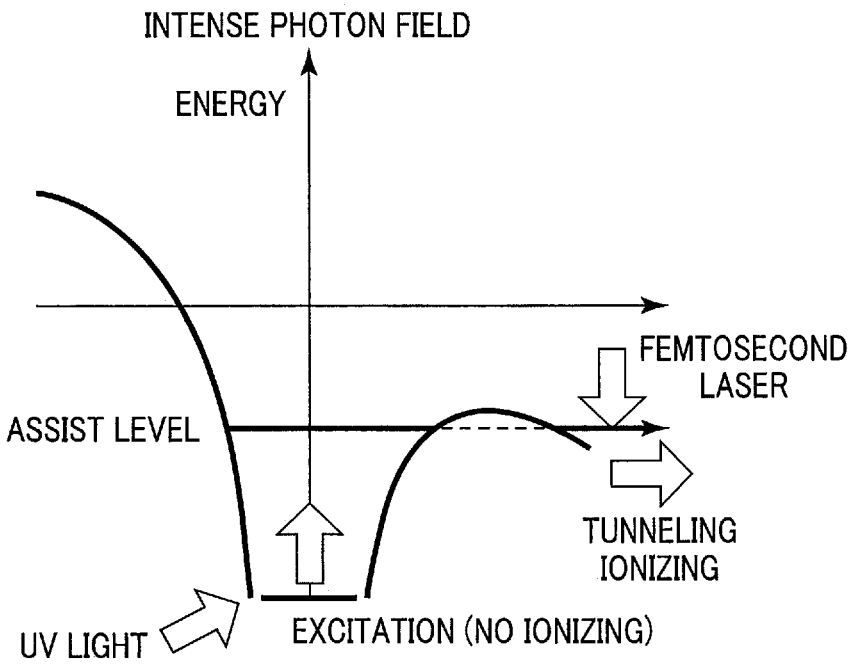
FIG. 4 is an explanatory diagram of the mass spectrometry method with an assist laser.

Hereinafter, a description will be given of a mass spectrometer 100 and a mass spectrometry method according to the first embodiment with reference to FIG. 1 to FIG. 4. FIG. 1 is an explanatory diagram showing a configuration of the mass spectrometer 100 according to the present embodiment. FIG. 2 is an explanatory diagram showing a configuration of a part of the mass spectrometer 100. FIGS. 3 and 4 are explanatory diagrams of the mass spectrometry method according to the present embodiment.

As shown in FIGS. 1 and 2, the mass spectrometer 100 includes an analysis chamber 10, a sample holder 12 located in the analysis chamber 10, an ion beam source 20, a laser light source 30 as an ionization light source, an assist energy source 40, a mass spectrometer unit 50 (analysis unit), and a controller 60.

The analysis chamber 10 includes a decompression chamber 11 with, for example, an exhaust device. The analysis chamber 10 can provide a decompression-state (vacuum) space inside.

The sample holder 12 is located in the analysis chamber 10, and includes a sample stage 12*a* and a moving device 12*b* that moves the sample stage 12*a*. The sample stage 12*a* includes a sample placement surface 12*c* that places and supports a sample on its surface, and is provided to hold a sample 13. The moving device 12*b* is connected to the controller 60. The moving device 12*b* moves the sample stage 12*a* in three axial (x, y, and z) directions under the control of the controller 60, and adjusts the position of the sample stage 12*a*. In addition to this, it is also possible to provide a mechanism to rotate the sample stage. In the present embodiment, target space A1 is arranged at a predetermined position on the sample stage 12*a*.

The target space A1 is between the mass spectrometer unit 50 and the sample 13, and is a space in which particles generated by sputtering followed by ion beam bombardment from the ion beam source 20. The target space A1 is appropriately set by the apparatus. In the present embodiment, a detection axis C4, connecting the sample surface 12*c* of the sample stage 12*a* and the mass spectrometer unit 50, is a first direction along a direction in which particles are mainly released and a direction in which ions are introduced. The target space A1 is placed between the sample stage 12*a* and the mass spectrometer unit 50, and on a secondary side of the sample stage 12*a* in the first direction. As an example, in the mass spectrometer 100 according to the present embodiment, an example is shown in which the first direction is along the vertical direction, and the secondary side of the first direction is the upper side.

The ion beam source 20 is, for example, a focused ion beam apparatus (FIB) that irradiates the sample 13 placed on the sample stage 12*a* with a pulsed ion beam. The ion beam source 20 irradiates, for example, a region where the sample 13 on the sample stage 12*a* is placed with an ion beam irradiation area. The ion beam source 20 aims at a position where at least part of the particles from the sample 13 are released to the predetermined target space A1. In the present embodiment, the ion beam source 20 is directed to the sample surface 13 through the target space A1, that is, at an obliquely upper side of the target space A1. The ion beam source 20 produces an ion beam toward the sample 13 on the sample table 12*a*.

The ion beam source 20 includes an ion source 21, an acceleration electrode 22, a condenser lens 23, an aperture 24, deflection electrodes 25 and 26, an objective lens 27, and a casing 28 accommodating them and having an irradiation port 28*a* at the end. The casing 28 is provided with the acceleration electrode 22, the condenser lens 23, the aperture 24, the deflection electrodes 25 and 26, and the objective lens 27 arranged in this order along a predetermined beam axis C1 from the ion source 21 toward the secondary side of the ion beam.

The ion source 21 generates ions from a supplied liquid or gas, by heating, application of a high voltage, treatment using plasma, or the like. The ion source 21 generates ions such as oxygen, cesium, gallium, gold, bismuth, argon, krypton, or xenon, including their clusters.

The acceleration electrode 22 includes one or more electrodes. The acceleration electrode 22 forms an ion beam by extracting and accelerating the ions generated by the ion source 21.

The condenser lens 23 includes, for example, a plurality of electrodes 23*a*. The condenser lens 23 is disposed between the acceleration electrode 22 and the aperture 24. The condenser lens 23 focuses the ion beam formed by the acceleration electrode 22, and reduces the diameter of the ion beam.

The aperture 24 includes an electrode plate 24*a* having a hole formed therein. The aperture 24 is arranged on the distal side of the condenser lens 23 and between the condenser lens 23 and the deflection electrode 25. The aperture 24 reduces the aberration of the condenser lens 23.

The plurality of deflection electrodes 25 and 26 are placed in parallel between the aperture 24 and the objective lens 27 along the beam axis C1. The deflection electrodes 25 and 26 deflect the ion beam to adjust the irradiation position of the ion beam.

The objective lens 27 is placed on the secondary side of the beam axis C1 with respect to the deflection electrodes 25 and 26. The objective lens 27 further focuses the ion beam focused by the condenser lens 23 and the aperture 24. The objective lens 27 focuses the ion beam on the surface of the sample 13.

A laser light from the laser light source 30 passes through just above while the sample 13 is irradiated with the ion beam, and irradiates laser light LA1 for ionizing the released particles. The laser light source 30 irradiates high-density laser light toward the target space A1 between the mass spectrometer unit 50 and the sample 13 and where particles generated by sputtering by the ion beam source 20 are released, thereby forming an intense photon field in a space including at least a part of the target space A1. The laser light source 30 includes a laser generator, and an optical system for focusing the laser to be irradiated. The laser light source 30 is arranged laterally, for example, in a horizontal direction, of the target space A1 in which the particles are released, on the secondary side of the first direction of the sample stage 12*a*. The laser light source 30 is located at a position where the laser light LA1 can be irradiated toward the target space A1 above the sample 13 while avoiding the sample 13. In the present embodiment, the laser light LA1 is irradiated toward the target space A1 along a horizontal laser optical axis C2 that is slightly, for example, approximately 100 μm above the sample 13.

The laser light LA1 irradiated from the laser light source 30 is pulsed laser light having a predetermined power density, for example, femtosecond laser light. The power density of the laser light LA1 is preferably of the high intensity said to cause tunnel ionization, and is set to a power density of, for example, $10^{14}$ W/cm$^2$ or more.

The assist energy source 40 controls the intensity of irradiation energy and the irradiation timing (supplying timing). For example, the assist energy source 40 supplies energy smaller than the laser light LA1 to the target space A1 at the same time as irradiation with the laser light LA1 or before irradiation with the laser light LA1.

The assist energy source 40 is, for example, a UV lamp 41 having a UV light source that sets the target space A1 to an excitation environment, by supplying UV light (assist light) as assist energy to the target space A1.

The UV lamp 41 is disposed at a position where UV light can be irradiated to the target space A1 of the sample 13 from a direction intersecting the beam axis C1, the laser light axis C2, and the detection axis C4. For example, the UV lamp 41 is arranged in a horizontal direction different from the laser light source 30 in the target space A1.

The particles derived from the sample released to the target space A1 at least partially included in the irradiation range of the UV light LU1 are excited by the UV light LU1 prior to ionization by the laser light LA1.

Here, the supplied assist light has enough energy to promote tunnel ionization in a later step without ionizing the particles present in the target space A1. For example, the assist light raises an element having electrons at a deep level and having a low ionization yield to a discretionary assist level which is a virtual or actual level at which tunnel ionization is likely caused.

It is preferable that the energy of the assist light is equal to or less than the ionization energy. The power density of the assist light is preferably such that it suppresses the probability of tunnel ionization and also suppresses non-resonant multiphoton ionization. Specifically, the assist energy is set to a power density lower than $10^{14}$ W/cm$^2$ of high intensity that is said to cause tunnel ionization, and preferably a power density of $10^{13}$ W/cm$^2$ or less. In addition, in order to obtain a certain assist effect, the assist energy is preferably set to a power density greater than $10^{10}$ W/cm$^2$.

The energy of the assist light is preferably set, with reference to the bond dissociation energy of the target molecule, to energy larger than the bond dissociation energy, for example.

Moreover, the energy of the assist light is preferably set, with reference to the ionization energy of the target specific element, to energy smaller than the ionization energy thereof, that is, preferably set to have a wavelength longer than the wavelength corresponding to the ionization energy. That is, by setting, as a target, an element having a high ionization energy (element not easily ionized) and exciting it to a predetermined assist level at which tunnel ionization is likely caused beforehand, the ionization yield can be increased and the high sensitivity analysis can be performed.

For example, if the target element is F (fluorine), the first ionization energy of F is 17.4 eV, and the corresponding light wavelength is 71 nm; thus, UV light as the assist energy for excitation preferably has energy less than 17.4 eV, i.e., a wavelength longer than 71 nm. Moreover, for example, if the target is P (phosphorus), the first ionization energy is 10.5 eV, and the light wavelength is 118 nm; thus, UV light as the assist energy for excitation preferably has energy less than 10.5 eV, i.e., a wavelength longer than 118 nm. Furthermore, for example, if the target element is He (helium) having the largest ionization energy among all the elements, the first ionization energy is 24.6 eV, and the corresponding light wavelength is 50 nm; thus, UV light as the assist energy for excitation preferably has energy less than 24.6 eV, i.e., a wavelength longer than 50 nm.

For the mass spectrometer unit 50, various devices are applicable such as a sector magnetic field mass spectrometer, a time-of-flight mass spectrometer, a quadrupole mass spectrometer, etc. The mass spectrometer unit 50 is arranged on the secondary side of the first direction of the target space A1, that is, arranged on the upper side.

For example, the mass spectrometer unit 50 is located on the upper side of the sample stage 12*a* with the target space A1 therebetween, i.e., on the secondary side of the first direction, to face the sample stage 12*a*. The mass spectrometer unit 50 includes a draw-in electrode 51, an electrostatic lens 52, deflection electrodes 53 and 54, a separator 55, an ion detector 56, and a casing 58 accommodating them. The casing 58 is provided with the draw-in electrode 51, the electrostatic lens 52, the deflection electrodes 53 and 54, the separator 55, and the ion detector 56 side by side along a predetermined detection axis C4 from the ion incident side toward the secondary side.

The detection axis C4 along the ion introduction direction extends along the vertical direction orthogonal to the planar direction of the sample placement surface 12*c* of the sample stage 12*a*, for example, orthogonal to a horizontally extending laser optical axis C2 and a UV light irradiation direction C3. The laser optical axis C2 and the UV light irradiation direction C3 intersect each other in the target space A1. In the present embodiment, the arrangement relationship between the respective mechanisms is practically considered, and the axes C1 to C4 intersect one another. However, as long as the direction in which the laser optical axis C2 is not directed to the sample 13 is maintained, it is possible to have a structure in which the respective axes do not intersect, or a structure in which one axis is shared.

When the draw-in electrode 51 is supplied with a predetermined voltage providing a potential gradient capable of drawing-in the ionized element, an electric field is formed between the drawing-in electrode 51 and the sample stage 12*a*. By this electric field, ions in the target space A1 are drawn into the mass spectrometer unit 50.

The electrostatic lens 52 is disposed on the secondary side with respect to the draw-in electrode 51. The electrostatic lens 52 focuses the passing ions onto the ion detector 56.

The deflection electrodes 53 and 54 are arranged on the secondary side with respect to the electrostatic lens 52. The deflection electrodes 53 and 54 deflect the ion trajectory toward the separator 55.

The separator 55 is disposed on the secondary side with respect to the deflection electrodes 53 and 54. The separator 55 mass-separates the ionized element to be analyzed, and passes it to the secondary side. The ions that have passed through the separator 55 are introduced into the ion detector 56.

The ion detector 56 is located on the secondary side with respect to the separator 55. The ion detector 56 measures the number of ions that have passed through the separator 55. The ion detector 56 sends the detection data to the controller 60.

The controller GO is connected to each unit of the mass spectrometer 100, and controls the operation of each unit of the mass spectrometer 100. For example, the controller 60 is connected to an exhaust device (not shown) of the analysis chamber 10, the moving device 12*b*, the ion beam source 20, the laser light source 30, the assist energy source 40, and the mass spectrometry unit 50. For example, the controller 60 controls the magnitude and the application timing of voltages applied to the various lenses and electrodes of the ion beam source 20, the laser light source 30, the assist energy source 40, and the mass spectrometry unit 50.

Hereinafter, the mass spectrometry method according to the present embodiment will be described with reference to FIGS. 3 and 4. The mass spectrometry method according to the present embodiment includes irradiating a sample with an ion beam under reduced pressure to sputter the sample, supplying energy for exciting particles released from the sample by the sputtering, and irradiating the particles with laser light for ionizing the particles.

First, the sample 13 is set on the sample placement surface 12*c* of the sample stage 12*a*. The controller 60 controls the moving device 12*b* to adjust the position of the sample 13 on the sample placement surface 12*c*.

Next, the controller 60 drives the assist energy source 40 at the timing of T1, irradiates the target space A1 with UV light LU1 at a predetermined output, and sets the target space A1 included in the optical path to an excited state.

Next, the controller 60 drives the ion beam source 20 at the timing of T2, irradiates a pulsed ion beam toward the sample 13 to sputter the sample 13, and stops the irradiation of the ion beam at the timing of T3. The sample on the sample stage 12*a* is sputtered by the ion beam irradiated from the ion beam source 20, and the particles such as atoms and molecules derived from the sample 13 are released to the target space A1 excited by the UV light LU1. In the particles released to the excited state target space A1, electrons in the atoms are excited. By this excitation, the element having electrons at a low level, in other words, having large ionization energy, is raised to a predetermined assist level at which tunnel ionization likely occurs.

Here, the particles released from the surface by sputtering contain many of those composed of a plurality of atoms; however, since the target space A1 is in an excited state by the UV light LU1 irradiated beforehand, dissociation and decomposition of fragment ions are promoted, and the proportion of monoatomic particles in the released particles is increased.

The controller 60 drives the laser light source 30 at the timing of T4, irradiates the target space A1 with the laser light LA1, and ceases the irradiation with the laser light LA1 at the timing of T5. A strong photon field is formed by the laser light LA1, and the particles are ionized by the tunnel effect. That is, the controller 60 controls the irradiation timing to irradiate the UV light LU1 during the period of irradiation with the laser light LA1.

By setting the target space A1 to be in the excited state in advance, the residual gas components of residual gas in the vacuum and desorption gas from the surface of the sample 13 are bonded and dissociated for fragmentation instead of ionization; thus, gas having the molecular weight that may cause interference is decomposed in the laser optical path, and interference is not caused.

Next, the controller 60 drives the mass spectrometer unit 50 to analyze ions. Specifically, the controller 60 applies a voltage to the draw-in electrode 51, and forms an electric field between the draw-in electrode 51 and the sample stage 12*a*. By this electric field, ions in the target space A1 are drawn into the mass spectrometer unit 50. The ions drawn in by the electric field are focused by passing through the electrostatic lens 52, and the trajectory is adjusted towards the separator 55 by the deflection electrodes 53 and 54. The trajectory-adjusted ions are mass-separated by the separator 55, and pass to the upper side, which is the secondary side of the first direction, and the ions passing through the separator 55 are introduced into the ion detector 56. The ion detector 56 measures the number of ions that have passed through the separator 55. The ion detector transmits the detection data to the controller 60, and the controller 60 obtains a mass analysis result from the data.

According to the mass spectrometer 100 and the mass spectrometry method according to the present embodiment, since the UV lamp 41 is provided as the assist energy source 40 to supply the assist light for exciting the particles, the particles are excited prior to tunnel ionization, and this can improve the ionization yield of tunnel ionization. That is, an element having high ionization energy and having electrons at a level lower than the range where tunnel ionization is possible is excited by irradiation with the UV light LU1, thereby raising the element to the assist level at which tunnel ionization is easily caused; in this manner, the ionization by the laser light LA1 can be promoted. Thus, an element that is electrically negative and high in ionization energy, such as halogens, can be analyzed in a highly-sensitive manner at a single analysis unit. Therefore, improvement in the functionality of materials and provision of effects on production management can be expected.

In addition, in general, particles released from the surface by sputtering include those composed of a plurality of atoms. The mass spectrometer 100 according to the present embodiment excites particles by supplying the assist energy before ionization to promote dissociation and decomposition of fragment ions, and this can improve the proportion of monoatomic particles in the released particles. Therefore, according to the mass spectrometry method using the mass spectrometer 100, ionization is promoted with the laser light LA1, and this can improve ionization probability, hence analytical sensitivity.

Furthermore, according to the mass spectrometer 100 of the present embodiment, the particles are excited by supplying the assist energy before ionization to promote dissociation and decomposition of the fragment ions, and this can reduce interference of the mass spectrum due to gas species in the vacuum. That is, femtosecond lasers may detect residual gas in vacuum as well as desorption gas from the sample surface due to the high ionization yield, and tend to detect trace elements in solids in a highly sensitive manner. In the mass spectrometer 100 according to the present embodiment, the assist energy is supplied before ionization, and the residual gas components are bonded and dissociated to be fragmented instead of being ionized, whereby the gas having the molecular weight that may cause interference is decomposed in the laser optical path and interference does not occur. For this reason, it is possible to ionize in a space where the residual gas interference is small, and interfering ions such as hydrocarbons are not detected, and the detection limit of a desired element can be lowered.

For example, if the diameter of the laser light is 0.5 mm at room temperature, the space is again filled with the residual gas by molecular motion in a few microseconds. Therefore, by introducing the laser light LA1 for ionization within about 1 microsecond from the supply of the assist energy, it is possible to ionize in a space with less residual gas, and it is possible to lower the detection limit of the element.

In addition, in the present embodiment, by using UV light capable of giving off high energy in a range not to be ionized as assist energy, it is possible to obtain an effect that atoms (particles) can be excited efficiently.

According to the above-described embodiment, an assist energy source that supplies energy for exciting particles is provided to excite the particles by supplying the assist energy, thereby the ionization is promoted and the sensitivity of ionization can be improved. Further, according to the embodiment, ionization can be promoted by promoting dissociation and decomposition of fragment particles generated on the sample surface.

The present invention is not limited to the above embodiment. For example, UV light is continuously irradiated in the above embodiment, but the present invention is not limited to this example. For example, it is also possible to irradiate UV light, as an assist energy, with a pulse. For example, the irradiation timing of the UV light may be a pulse that is synchronized with the pulse of the ion beam irradiation from the ion beam source 20. Specifically, the timing T1 of turning on the UV light may be before the timing T4 of turning on the laser light, and the timing T1 may be the same timing as the timing T2 of turning on the ion beam or the timing T3 of turning off the ion beam. The timing of turning off the UV light may be at or after the timing T4 of turning on the laser light, and may be at the same timing as or after the timing T5 of turning off the laser light. During irradiation with the laser light, it is preferable to irradiate UV light as assist energy.

In the above-described embodiment, the UV lamp 41 that irradiates UV light as the assist light is exemplified as the assist energy source 40, but the present invention is not limited thereto. For example, as the assist energy source 40, a UV laser device such as an LED or a nanosecond UV laser device may be used other than the UV lamp 41.

Furthermore, as another embodiment, the assist energy source 40 may be configured so that the energy (=wavelength) to be supplied can be adjusted. Specifically, by providing UV light sources of a plurality of wavelengths in the UV laser device or by configuring the UV laser device to selectively switch or incorporate UV light sources of different wavelengths, the wavelength of the UV light to be irradiated may be adjustable. In this case, it is possible to select the wavelength corresponding to the type of the targeted element at the site of use, or set the wavelength corresponding to the specific element at the time of shipment.

When a tunable laser is used as the assist light, the excited state can be created aiming at a specific level, and thus the sensitivity may be increased by the assist light while providing element selectivity for ionization. In this case, it is possible to further reduce the power density of the laser light than the usual resonance ionization. Thus, by making the assist light tunable and with element selectivity, it is possible to obtain the effect that even an element that is difficult to ionize by ordinary resonant ionization due to too high ionization potential can be ion-detected with high sensitivity and in the absence of interfering ions.

In the above embodiment, UV light is exemplified as the assist energy for exciting particles, but the present invention is not limited to this. For example, in addition to UV light, energy such as laser light, plasma, microwave, electron beam, or the like, may be used as the assist energy. In this case, assist energy can be supplied by using, as the assist energy source 40, a laser device that irradiates a laser light, a plasma generator that generates plasma, a microwave oscillator that oscillates microwaves, an electron beam source that irradiates a low-speed electron beam, or the like. That is, any configuration may be adopted as long as energy lower than the ionization energy of the target element can be supplied so that the state can be any close to a state in which the target element is tunnel-ionized by the assist energy to be supplied.

Even a wavelength that supplies energy lower than the ionization energy may be tunnel-ionized when supplied in a wavelength band close to the resonant wavelength (resonance wavelength), and thus it is desirable to avoid such a wavelength band. For example, this applies to wavelength bands around 310 to 330 nm for Ti, around 280 to 290 nm for Mg, and 300 nm or around 150 nm for P.

Furthermore, the ion beam source 20 and the mass spectrometer section 50 each include the ion-optical systems such as lenses and electrodes in the casing 28 or 58, but the present invention is not limited to this, and a part thereof may be disposed outside. Moreover, the ion beam source, the mass spectrometry unit, and the like are not limited to the structure of the present embodiment, and may be replaced with those having other structures generally known. In addition, other than the above-described components, it is possible to add or reduce components as needed such as electrodes and lenses.

In the above embodiment, the sputtered neutral mass spectrometer and the sputtered neutral mass spectrometry method are exemplified, but the present invention is not limited to this, and for example, the present invention can be applied to a mass spectrometer for analyzing gas for a gas sample.

According to the mass spectrometer of at least one embodiment described above, an assist energy source for supplying energy for exciting particles is provided to excite particles, thereby promoting ionization and improving sensitivity of ionization.

Furthermore, according to the mass spectrometry method of at least one embodiment described above, by supplying the energy to excite particles released from a sample by sputtering to the particles, the particles are excited, thereby promoting ionization and improving probability of ionization.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A sputtered neutral particle mass spectrometer comprising:

a sample stage provided to hold a sample;

an analysis unit disposed to face a sample placement surface of the sample stage, and performing mass analysis;

an ion beam source provided to radiate an ion beam toward the sample placement surface;

an assist energy source supplying assist energy to a target area between the sample placement surface and the analysis unit; and an ionizing laser light source irradiating the target area with laser light to cause ionization while avoiding irradiating the sample, wherein the assist energy source comprises at least any one of a UV lamp, an LED, a laser device, a plasma generator, a microwave oscillator, or an electron beam source, and supplies the assist energy to the target area so as to supply, at least during a period of ionizing laser light irradiation, the assist energy to particles released from the sample by sputtering the sample by irradiation with the ion beam to promote ionization, wherein energy supplied from the assist energy source is smaller than first ionization energy of a target element to be mass analyzed, and has a power density lower than that of the ionizing laser light and wherein the target area is an area in which the particles generated by sputtering the sample are released, and located on a secondary side with respect to the sample, the secondary side being in a first direction in which the particles are released; and wherein a laser does not intersect with the sample.

2. The mass spectrometer according to claim 1, further comprising a controller controlling an irradiation timing of the laser light and a supply timing of the assist energy.

3. A sputtered neutral particle mass spectrometry method, comprising, irradiating a sample with an ion beam to sputter the sample;

supplying assist energy that excites particles released from the sample by the sputtering to the particles; and irradiating, while avoiding irradiating the sample, a target area between the sample and an analysis unit performing mass analysis with an ionizing laser light for ionizing the particles, wherein the assist energy is UV light, LED light, laser, plasma, microwave, or an electron beam, smaller than first ionization energy of a target element to be mass analyzed, has a power density lower than that of the ionizing laser light, and is applied to the target area so as to supply, at least during a period of ionizing laser light irradiation, the assist energy to particles released from the sample by sputtering the sample by irradiation with the ion beam to promote ionization, and wherein the target area is an area in which the particles generated by sputtering the sample are released, and located on a secondary side with respect to the sample, the secondary side being in a first direction in which the particles are released; and wherein a laser does not intersect with the sample.

4. The mass spectrometer according to claim 1, wherein the assist energy is energy having a magnitude promoting ionization.

* * * * *